US006978477B2

(12) United States Patent
Foote

(10) Patent No.: US 6,978,477 B2
(45) Date of Patent: Dec. 27, 2005

(54) EQUESTRIAN HELMET WITH FACEGUARD

(76) Inventor: Frederick C. Foote, 5820 Shoeman Rd., Haslett, MI (US) 48840

( * ) Notice: Subject to any disclaimer, the term of this patent is extended or adjusted under 35 U.S.C. 154(b) by 22 days.

(21) Appl. No.: 10/829,881

(22) Filed: Apr. 22, 2004

(65) Prior Publication Data

US 2005/0235401 A1 Oct. 27, 2005

(51) Int. Cl.[7] ..... A42B 1/00
(52) U.S. Cl. ..... 2/9; 2/424; 2/425
(58) Field of Search ..... 2/424, 425, 421, 2/422, 410, 411, 10, 9

(56) References Cited

U.S. PATENT DOCUMENTS

| | | | | | |
|---|---|---|---|---|---|
| 2,867,812 | A | | 1/1959 | Roth et al. | |
| 2,892,195 | A | | 6/1959 | Monetta | |
| 2,986,739 | A | | 6/1961 | Rozzi, Sr. | |
| 3,283,336 | A | * | 11/1966 | Critser | 2/9 |
| 3,445,860 | A | * | 5/1969 | Rodell | 2/422 |
| 3,889,296 | A | * | 6/1975 | Martin | 2/9 |
| 3,946,442 | A | | 3/1976 | Wallander | |
| D243,128 | S | | 1/1977 | Morgan | |
| 4,042,974 | A | | 8/1977 | Morgan et al. | |
| 4,233,687 | A | | 11/1980 | Lancellotti | |
| 4,271,537 | A | * | 6/1981 | Bowlus et al. | 2/424 |
| D262,326 | S | | 12/1981 | Lonnstedt | |
| 4,587,677 | A | * | 5/1986 | Clement | 2/424 |
| 4,713,844 | A | | 12/1987 | Westgate | |
| 4,774,729 | A | | 10/1988 | Coates et al. | |
| 4,885,807 | A | | 12/1989 | Snow, Jr. | |
| 4,947,490 | A | * | 8/1990 | Hayden | 2/424 |
| 4,985,938 | A | | 1/1991 | Snow, Jr. | |
| 5,093,936 | A | | 3/1992 | Copeland et al. | |
| 5,101,517 | A | * | 4/1992 | Douglas | 2/424 |
| 5,129,108 | A | | 7/1992 | Copeland et al. | |
| D336,552 | S | | 6/1993 | Timms et al. | |
| RE34,699 | E | | 8/1994 | Copeland et al. | |
| 5,384,914 | A | | 1/1995 | Caveness et al. | |
| D355,508 | S | | 2/1995 | Tutton et al. | |
| 5,477,565 | A | | 12/1995 | Hunt, Jr. | |
| D366,539 | S | | 1/1996 | Lackovic | |
| D369,441 | S | | 4/1996 | Crestin-Billet | |
| 5,502,843 | A | | 4/1996 | Strickland | |
| 5,517,698 | A | | 5/1996 | Nault et al. | |
| 5,571,220 | A | | 11/1996 | Hall | |
| 5,575,018 | A | | 11/1996 | Rothrock | |
| 5,619,755 | A | | 4/1997 | Casartelli | |

(Continued)

FOREIGN PATENT DOCUMENTS

| | | | | |
|---|---|---|---|---|
| DE | 3744114 A1 | | 10/1988 | |
| GB | 2201330 A | * | 9/1988 | A42B 3/00 |

OTHER PUBLICATIONS

"Exhibit A—discloses prior art equestrain helments found at www.victorycanter.com," 5 pgs., published at least prior to Mar. 18, 2004.

(Continued)

*Primary Examiner*—Rodney M. Lindsey
(74) *Attorney, Agent, or Firm*—Price, Heneveld, Cooper, DeWitt & Litton LLP

(57) ABSTRACT

A helmet, such as for equestrian sports, includes an impact resistant outer helmet shell formed to cover a portion of a wearer's head, the shell having an upper dome and also having a lower rim extending around the dome. The shell has lateral side portions with outer surfaces that are relatively smooth, and further has integrally formed attachment structure (receptors) with downward openings such that they are not visible from the sides of the helmet. A faceguard has arms with integrally formed latches that engage the receptors with an audible click. The latches can be pinched to release the faceguard with a smooth easy motion.

35 Claims, 6 Drawing Sheets

U.S. PATENT DOCUMENTS

| | | | | |
|---|---|---|---|---|
| 5,675,875 | A | 10/1997 | Servatius | |
| 5,713,082 | A | 2/1998 | Bassette et al. | |
| 5,715,541 | A | 2/1998 | Landau | |
| 5,718,004 | A | 2/1998 | Broersma et al. | |
| 5,896,590 | A | 4/1999 | Fleisch | |
| 5,963,990 | A | 10/1999 | White | |
| 5,966,744 | A | 10/1999 | Smith, Jr. | |
| 5,987,652 | A | 11/1999 | Fowler | |
| 6,047,400 | A | 4/2000 | Spencer | |
| 6,085,357 | A | 7/2000 | Broersma | |
| 6,189,156 | B1 | 2/2001 | Loiars | |
| 6,257,398 | B1 | 7/2001 | Lindars | |
| D449,135 | S | 10/2001 | Martin et al. | |
| D449,713 | S | 10/2001 | Martin et al. | |
| 6,317,896 | B1 | 11/2001 | Timms et al. | |
| 6,499,139 | B1 | 12/2002 | Brown et al. | |
| D476,776 | S | 7/2003 | Finquel | |
| RE38,246 | E | 9/2003 | Leonard et al. | |
| 6,892,393 | B1 * | 5/2005 | Provost et al. | 2/10 |

OTHER PUBLICATIONS

"Exhibit B—discloses prior art Bond Street Polo Helmet found at www.horsemall.com", 2 pgs., published at least prior to Feb. 3, 2004.

* cited by examiner

EQUESTRIAN HELMET WITH FACEGUARD

BACKGROUND

The present invention relates to protective helmets with faceguards, and more particularly relates to an equestrian helmet with removable faceguard. However, it is noted that the present invention is believed to be usable in a variety of different circumstances and hence several aspects are believed to be broader in scope than just equestrian helmets.

The equestrian sport of "eventing" has become very popular. Eventing is the equivalent of an "equestrian triathlon" with the rider working with a horse both on the flat and over fences. The three phases are: dressage (the execution by a trained horse of precision movements in response to barely perceptible signals from its rider, somewhat like "show dancing"), endurance (sometimes called "cross country"), and show jumping. A different level of head protection is needed for the rider in each different event. In dressage, the traditional helmet shape and appearance is very important, since it has become an integral part of the elegant, graceful performance. Contrastingly, in the event of jumping, the rider needs to be protected from a fall but also the rider's face needs to be protected from colliding with the horse's head when jumping since the horse's head and rider's head may move rather violently in opposing directions during a jump. Also, the rider's helmet must not include protruding parts that may strike and injure the horse's head upon collision with the rider's helmet. In the event of cross country, the raw power and spirit of a horse and the dynamics of other riders and obstructions encountered require that the rider's head be very well protected against a fall, and yet his vision must be totally clear and unobstructed. There are also many other equestrian sports, some where a faceguard is desirable and others where it is not. Finally, in training horses for any of these sports, a faceguard is extremely useful when working with young, inexperienced or sprightly horses that are prone to rearing, bucking or "spooking" (lurching with fear) and endangering the rider's head and face.

Despite this need for head and face protection, faceguards have not been developed for equestrian helmets. The reasons are many and varied. I believe that riders do not like to keep multiple helmets around, and do not like to (nor have time to) switch helmets during a competition. It is desirable to provide an equestrian helmet with a removable faceguard to solve this problem, but equestrian helmets have requirements that make them unique and that "complicate" this problem. Riders require a wider field of vision than in most sports and, further, they need the ability to turn their head without restriction from the helmet. Also, the helmet must also be sufficiently light in weight and open around the chin and ears so as to not be a hindrance.

Furthermore, in some equestrian sports such as dressage, appearance is extremely important. The helmet needs to have a very particular outer shape and appearance, and it is not acceptable to have any bulge or appendage, especially on the sides of the helmet. In particular, it is not acceptable to have any protruding attachment structure, whether the faceguard is attached or not. An outwardly protruding attachment structure on a helmet is not only potentially unsightly to equestrian sportsmen (and judges), but it can also be a safety hazard in terms of its potential for causing injury to the horse or rider or for catching or snagging an obstacle or the ground during a fall. Also, any protruding structure can interfere with (if not ruin) the removable bright fabric covers often placed over equestrian helmets when in a competition.

Finally, it would be undesirable if an equestrian helmet with a removable faceguard that was unattached looked as if it was missing something or otherwise imperfect.

More generally, sportsmen do not want to struggle with inserting and/or removing a faceguard. Instead, they would prefer an attachment system that is easy to release and reattach, and an attachment structure that is totally hidden from view. Also, it is desirable to provide a faceguard that provides a very positive engagement, including an audible indication or other positive action that indicates that a secure connection with the helmet has been made. Further, the faceguard must be attractively stylized to combine functional strength with appearance when the faceguard is attached. Removable faceguards even provide riders with the opportunity to swap faceguards made of different colors to match the brightly colored outfits and bright fabric helmet covers common in equestrian competitions.

Thus, a system having the aforementioned advantages and solving the aforementioned problems is desired.

SUMMARY OF THE PRESENT INVENTION

In one aspect of the present invention, an equestrian helmet includes an impact resistant outer helmet shell formed and adapted to cover a portion of a wearer's head. The shell has an upper dome and also has a lower rim extending from the forward portion of the dome, and then rearwardly above the wearer's ears to a pair of lateral side portions on each side of the dome, and then rearwardly and downwardly to a rearward portion of the dome where the rim is at its lowest point. The shell defines an outer surface and an inner surface with the outer surface at the lateral side portions being relatively smooth and characteristically not having outwardly protrusions thereon for reasons of safety and so that the helmet shell is adapted to receive fabric coverings without interference. The attachment structure, therefore, is formed on the lateral side portions inboard of the outer surface. The attachment structure is comprised of receptors with downward openings that are not visible from the side of the helmet. A faceguard with arms is provided that is shaped to releasably engage the receptors of the attachment structure.

In another aspect of the present invention, a protective helmet includes an impact resistant outer helmet shell formed to cover a portion of a wearer's head, the shell defining an outer surface and an inner surface. The outer surfaces at the lateral side portions of the helmet shell characteristically do not have outwardly protrusions thereon but do have an attachment structure facing downwardly and inboard of an outer surface of the shell. A faceguard has arms with rear sections that extend upwardly into releasable engagement with the attachment structure.

In yet another aspect of the present invention, a protective helmet includes an impact resistant outer helmet shell formed to cover a portion of a wearer's head, the shell having an upper dome and also having a lower rim extending from the forward portion of the dome, and then rearwardly above the wearer's ears to a pair of lateral side portions on each side of the dome, and then rearwardly to a rearward portion of the dome. The outer helmet shell includes attachment structures located in the lateral side portions of the dome. A faceguard includes arms each having a latch member thereon. The latch member is shaped to releasably engage the attachment structure and in particular is constructed to engage with an audible click as the arms are fully inserted into the attachment structure.

In yet another aspect of the present invention, a protective helmet includes an impact resistant outer helmet shell formed to cover a portion of a wearer's head, the shell having an upper dome and also having a lower rim extending from the forward the portion of the dome, and then rearwardly above the wearer's ears to a pair of lateral side portions on each side of the dome, and then rearwardly to a rearward portion of the dome. The outer helmet shell includes an attachment structure located in the lateral side portions of the dome. A one-piece faceguard includes arms each having a latch member supported by a living hinge, the latch member being shaped to releasably engage the attachment structure as the arms are fully inserted into the attachment structure.

In still another aspect of the present invention, a protective helmet includes an impact resistant outer helmet shell formed to cover a portion of a wearer's head, the shell having an upper dome and also having a lower rim extending from the forward portion of the dome, and then rearwardly to a pair of lateral side portions on each side of the dome, and then rearwardly to a rearward portion of the dome. The outer helmet shell includes an attachment structure located inside and integrally formed in the lateral side portions of the dome and that defines receptors opening downwardly. A U-shaped faceguard includes a cross bar(s) and L-shaped arms that extend upwardly from each side of the cross bar(s). The arms each have a horizontal section that extends generally horizontally from the cross bar and further have a vertical section that extends upwardly into engagement with the attachment structure. A rear surface of the horizontal section is located near the attachment structure so that stress from a frontal impact is transmitted from the cross bar through the horizontal section to the attachment structure and the helmet shell without substantial torque to the vertical section.

In another aspect of the present invention, a faceguard is provided for a protective helmet. The faceguard includes a one-piece faceguard having a crossbar adapted to protect a chin region of a person wearing the helmet, and having legs extending rearwardly from opposing ends of the crossbar. The legs each have a rearwardly-extending section and have an upwardly-extending section that is adapted to extend into contact with the helmet. The upwardly-extending section has an integrally-formed latch element supported by an integrally-formed living hinge thereon for interlockingly engaging a mating pocket in the helmet.

In still another aspect of the present invention, a faceguard for a protective helmet includes a one-piece faceguard having a crossbar adapted to protect the chin region of a person wearing the helmet, and having legs extending rearwardly from opposing ends of the crossbar. The legs each have a rearwardly-extending section that extends sufficiently rearward from the crossbar to leave a laterally-facing visually-open area adjacent to the eyes of the person and further have an upwardly-extending section that is adapted to extend into contact with the helmet. The upwardly-extending section has a latch element thereon adapted for securing the faceguard to the helmet.

An object of the present invention is to provide a protective helmet such as an equestrian helmet with a faceguard that can be easily installed or easily removed without objectionable visible evidence of the faceguard being missing when removed.

It is also an object of the present invention to provide a protective helmet with a faceguard where the faceguard can be removed with a simple finger pinching action.

It is also an object of the present invention to provide a protective helmet with a faceguard where the faceguard attaches with an audible click so that it is clear that secure connection has been satisfactorily completed.

It is also an object of the present invention to provide a protective helmet with a faceguard where the faceguard extends in a sweep from the helmet first downwardly below eye level and then forwardly in front of a person's chin or mouth so that a maximum field of vision is maintained yet improved protection to the person's jaw and face are provided.

It is also an object of the present invention to provide an aesthetic yet functional protective helmet with a faceguard designed to complement the shape of the classic equestrian helmet.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 5:
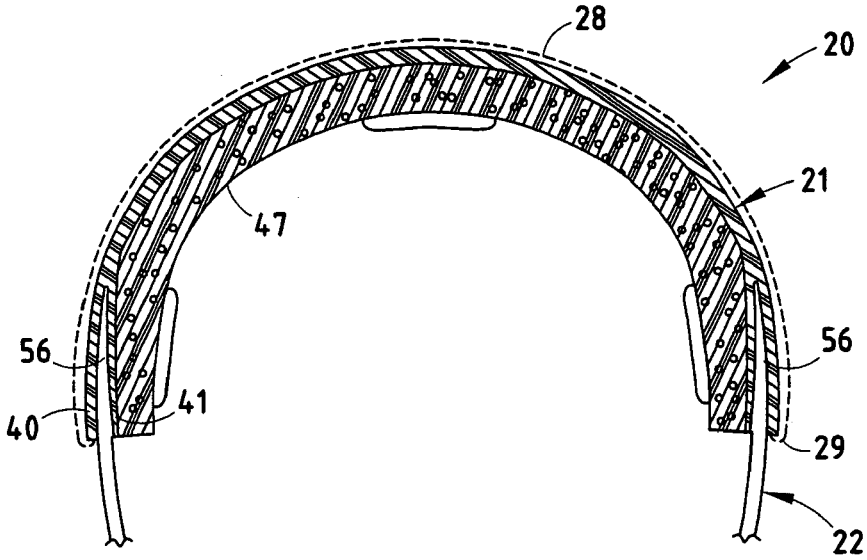
FIG. 5 is a cross section taken along lines V—V in FIG. 3.
Figure 4:
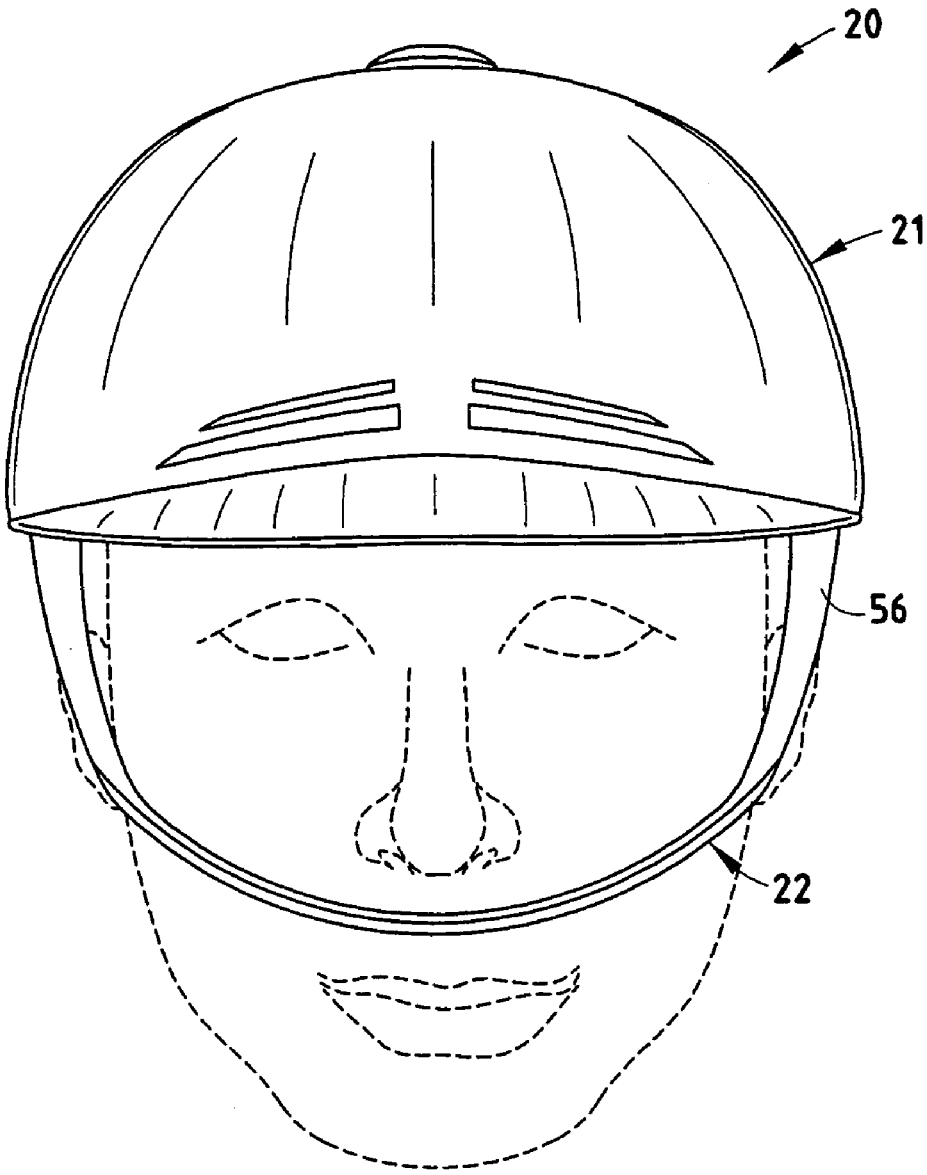
FIG. 4 is a front view of FIG. 1.

A helmet 20 (FIGS. 1–5) is illustrated that is particularly adapted for use in equestrian sports but it is contemplated that it is adapted for use in many other sports and situations where protective head gear is desired that allows a wide unobstructed field of view and where its faceguard may want to be easily and quickly removed. The illustrated helmet 20 (FIG. 3) includes an impact resistant outer helmet shell 21 and a U-shaped releasably-attached faceguard 22. The shell 21 is formed to cover the upper half and rear of a wearer's head. The shell 21 has an upper dome 23 and also has a lower continuous rim 24 extending around the dome 23. The shell 21 includes a front portion 25, lateral side portions 26, and a rear portion 27, all portions 25–27 having outer surfaces that are relatively smooth, particularly the lateral side portions 26. The reason for this is both aesthetics (i.e., to match the traditional shape of equestrian helmets) and also function (to avoid outward protrusions that can cause safety concerns). Notably in equestrian sports, the appearance is more than just a desire; in higher level competition, it is virtually a requirement as part of the grace and beauty judging that occurs. Accordingly, in some aspects of my design I consider this feature a physical requirement and not just a visual standard. Also, outward projections would interfere with the attachment of removable bright fabric coverings 28 (FIG. 5) that are often attached in equestrian sports over the shell 21. In particular the fabric coverings 28 can include a brightly covered material with a draw string or elastic member 29 around their lower perimeter to retain them to the helmet 20. Also, lateral projections are potentially injurious to a horse and/or rider, such as in jumping events where a rider may turn his/her head as the horse's head and rider's helmet abut, such that it is desirable to avoid lateral projections for additional reasons. Finally, it would be undesirable if a helmet with a removable faceguard looked as if it was missing something when the removable faceguard was not being used and was thus removed from the helmet.

Figure 6:
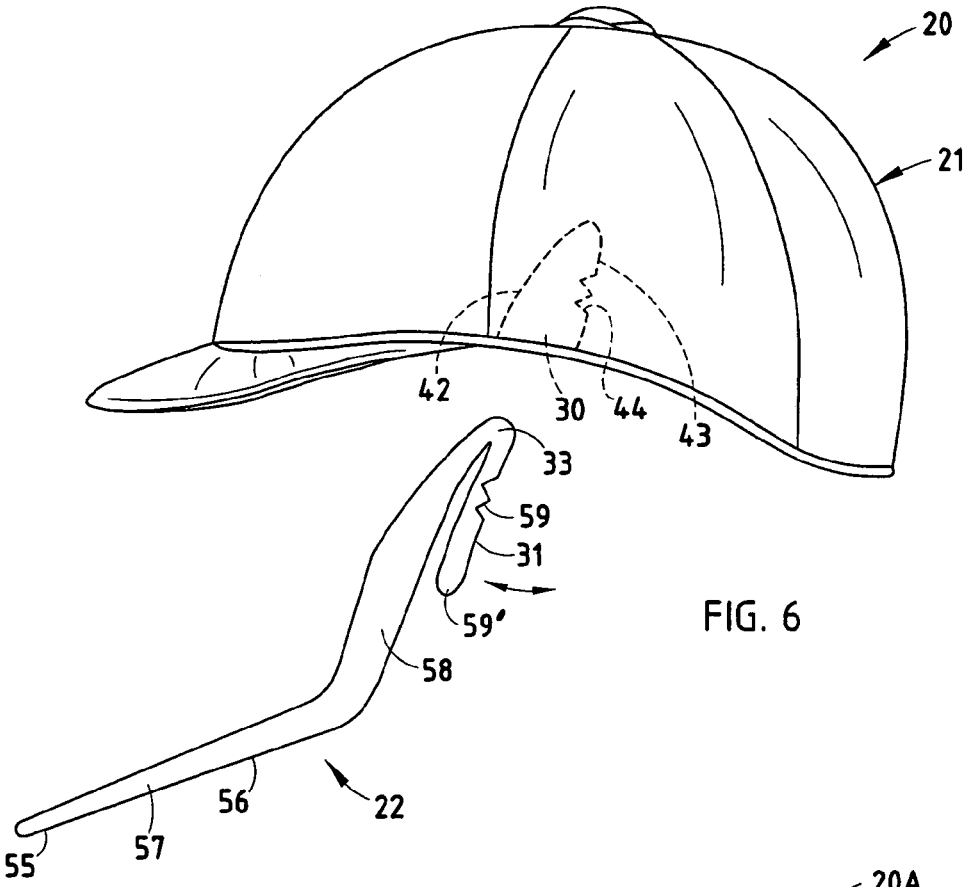
FIG. 6 is an exploded view of FIG. 4.

Inside of the lateral side portions 26 are integrally formed attachment receptors 30 (FIG. 6) (i.e., shark-tooth-shaped pockets), which are designed to be releasably engaged by the latch members 31 on the rearwardly extending portions of the faceguard 22, as discussed below. The attachment receptors 30 open downwardly through the rim 24, such that they are not visible from the sides or the front of the helmet 20, which is an important property of the present helmet 20 as discussed above. The latch members 31 are integrally formed and resiliently biased and supported on a tail end (or blade portion) of the rear upright section 58 by a living hinge 33 such that they securely engage the attachment receptors 30 with an audible click. Also, this allows them to be released by a simple pinching motion, allowing them to be quickly and easily released from the helmet 21 with a smooth easy finger motion.

The lateral side portions 26 of the helmet shell 21 (FIG. 5) include an outer wall 40 and inner wall 41 defining the receptor 30 therebetween. The receptor 30 (FIG. 6) has front and rear surfaces 42 and 43 that are angled toward each other. The illustrated surfaces 42 and 43 define a "shark tooth" shape that is conducive to molding since it provides for release of the blade in the molding die that formed the receptor 30. Further the tapered shape of the "shark tooth" receptor allows for easier insertion of the tail end of the upright section 58 and living hinge 33 without a precise alignment prior to insertion. On the rear surface 43 are one or more teeth 44. The illustrated teeth 44 are sufficiently high and perpendicular to the rear surface 43 such that they would require a slide or movable component on the blade of the molding die in order to prevent die lock. However, it is contemplated that there are ways to reduce any need for a movable slide in the molding die such as by tilting and/or shortening the teeth to extend parallel the front surface 42 or by making the teeth into depressions instead of protruding teeth or other ways known in the art of tool-making. It is contemplated that the walls 40–41 and surfaces 42–43 will be integrally molded as part of the helmet shell 21 to provide structural strength and to simplify and reduce costs of the helmet 20 but it is contemplated that the present invention includes other non-integral means of attachment such as an internally-positioned bracket.

A liner 47 (FIG. 5) is positioned inside of the helmet shell 21 for comfortably supporting the helmet shell 21 on a person's head. The illustrated liner 47 is made from expanded polymeric foam material such as expanded polystyrene pellets for optimal energy absorption to minimize any injury to a person's head upon impact. Such liner materials are well known in the industry of helmet manufacture and a detailed description of such is not necessary for an understanding of the present invention. The illustrated liner 47 includes a depression to matingly receive and engage the attachment receptor 30. A chin strap 48 (FIG. 3) is attached to the helmet shell 21 for retaining the helmet 20 to a rider's head. It is contemplated that the present invention will also work with many different liners and a variety of different chin strap arrangements. For example, the present invention will work with the harness-type support as shown in Timms et al. U.S. Pat. No. 6,317,896, the entire contents of which are incorporated herein by reference for the purpose of their teachings. A short visor 49 extends forwardly from the front portion 25 of the helmet shell 21. Also, ventilation apertures such as apertures 50 (FIG. 1) can be integrally formed in the helmet shell 21 such as immediately above the visor where they cause air flow across the rider's head. Other modifications to the helmet shell 21 and liner 47 can be made such as attachment of a top piece 51 to the dome 23.

The faceguard 22 (FIG. 6) is an integrally molded one-piece part having a U-shaped cross bar 55 that extends across the rider's face near his/her nose and mouth and further includes L-shaped arms 56 that extend upwardly. The arms 56 each include a front horizontal section 57 that extends generally horizontally and a rear upright or vertical section 58 that extends generally vertically. By this arrangement the field of vision, including peripheral vision, is maximized for the rider since the faceguard 22 is positioned well below the person's eyes. (See FIGS. 3–4.) Notably, the cross bar 55 and arms 56 can be made thicker or thinner and to have different optimally shaped cross sections to resist forces of impact. The illustrated cross section of the upper end of the arms 56 is rather long in a fore-to-aft direction (FIG. 6) for strength against a frontal impact but is relatively thin in a lateral direction (FIG. 5) to provide give and flexure in a lateral direction and to minimize intrusion into the space within the helmet shell 21 for the liner 47 and the rider's head. The portion of the blade as it enters the helmet shell 21 can be enlarged and present a step to resist the blade from acting as a wedge as a force attempts to cause the blade to move into the receptacle in the helmet. Alternatively, depending on material strengths, a step may not be required.

The tail end of the vertical section 58 (FIG. 6) is "blade" shaped and includes a thinned resilient region forming the integral living hinge 33. The latching member 31 extends in a reverse direction parallel the vertical section 58. The latching member 31, in its engaged position, is spaced slightly from the vertical section 58 and is biased outwardly to engage a tooth(s) 59 with the teeth 44 on the rear surface 43 of the receptor 30 of the attachment structure on the helmet shell 21. A lower end of the latching member 31 extends slightly below the rim 24 to form a tab-like handle 59'. By a simple finger action on the handle 59' first in a direction toward the vertical section 58 and then downwardly, the faceguard 22 can be quickly and easily removed. To engage the faceguard 22, the faceguard 22 is manipulated to place the living hinge 33 in the receptor 30, and then it automatically self-aligns as the faceguard 22 is moved upward into position. As the faceguard 22 moves to its fully inserted position, the tooth(s) 59 ramp onto the teeth 44 and then snap into position with an audible click. This is very desirable since it indicates to the rider that the faceguard 22 is fully inserted and locked into position. Also, I've found that the sound provides a feedback of secure connection to the rider that is greatly appreciated.

As noted above, the structure of faceguards (and also the aesthetics) are important in many equestrian sports. The illustrated faceguard 22 provides both. In particular, the flowing lines from the vertical section 58 create symmetry with the strap 48 (FIG. 3) that is believed to be acceptable to riders and judges of equestrian events. The forward section 57 also extends generally parallel the visor 49 in a similarly symmetrical and acceptable fashion. This is believed to be more than mere appearance, though it clearly also has novel, ornamental, and non-obvious distinctiveness, in my opinion.

Upon impact, the illustrated faceguard 22 (FIG. 3) is able to move and flex slightly as indicated by arrow 60. Notably, this action does not cause release of the latching member 31 due to the direction of forces generated in the present arrangement.

Additional embodiments of the present invention are presented below. Features that are similar or identical are identified using the same numbers as previously discussed but with the addition of a letter "A," "B," or "C." This is done for the purpose of reducing redundant discussion.

Figure 3:
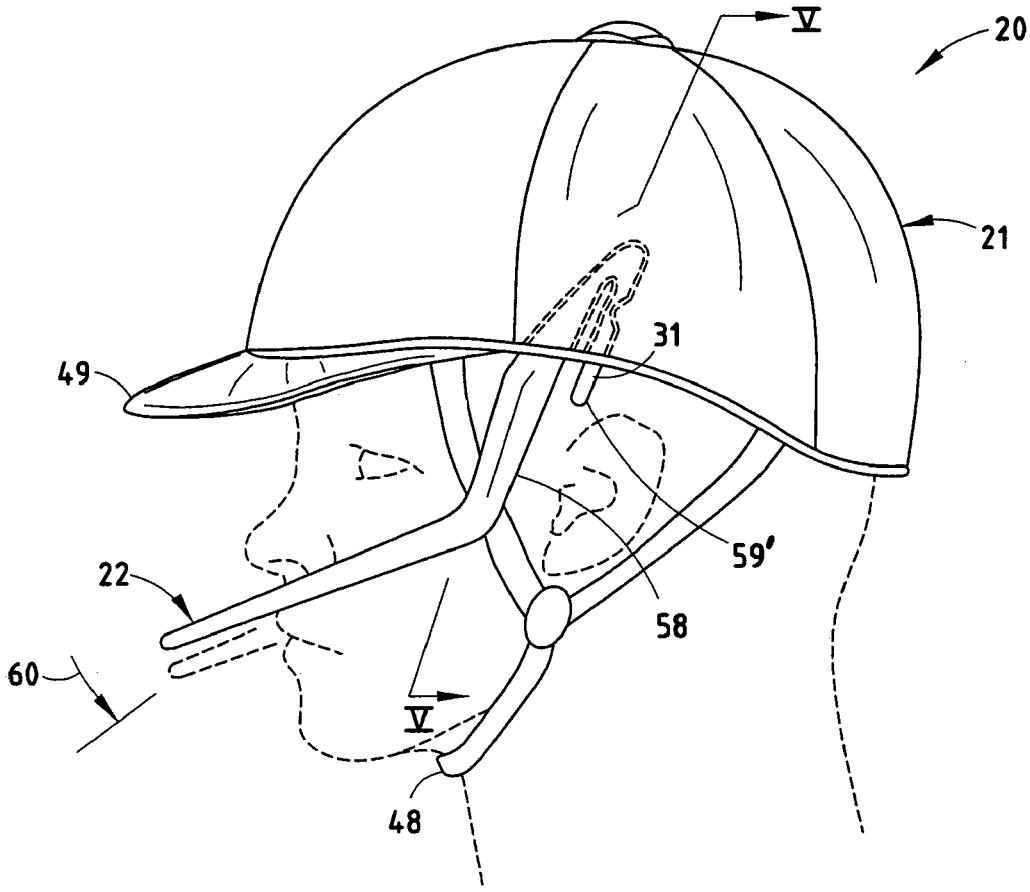
FIG. 3 is a side view of the helmet of FIG. 1, including a chin strap worn by a rider.
Figure 7:
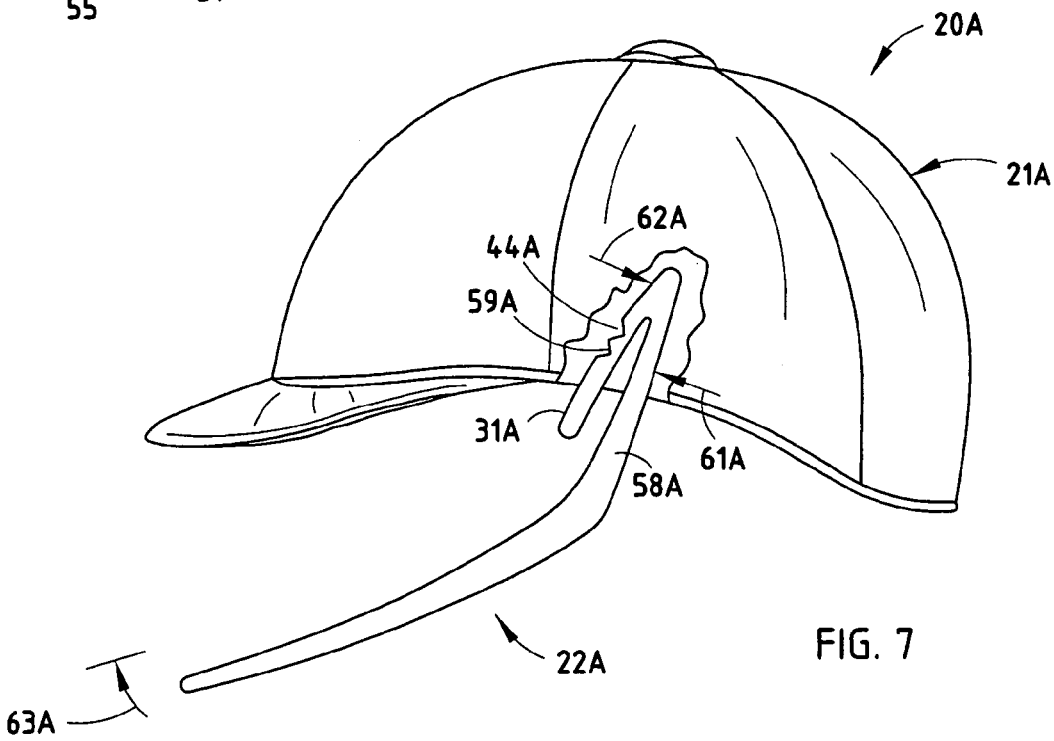
FIGS. 7–9 are side views of additional embodiments, similar to FIG. 1, but with modified latching systems, the helmet shell in each case being partially broken away to better show the latching system.

In an alternative faceguard 22A (FIG. 7), the latching member 31A is moved to a front side of the vertical section 58A which is the reverse of the faceguard 22 (FIG. 3). The teeth 44A (FIG. 7) are positioned on the front surface 42A, and latching tooth(s) 59 are similarly moved to a location on the latching member 31A for engagement with the teeth 44A. Upon impact, the faceguard 22A tends to immediately resist any impacting force by generation of a resisting torque created by forces from the helmet shell 21A indicated at arrows 61A and 62A. At the same time, any impact forces that would tend to force a person's head upward would be dampened by a limited movement 63A of the faceguard 22A as the vertical section 58A moves against the latching member 31A.

Figure 8:
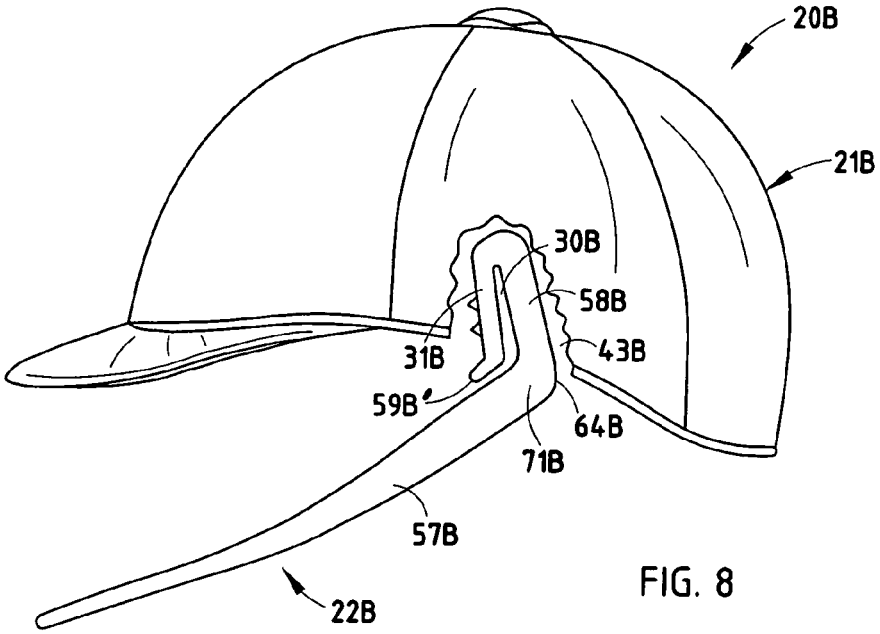

In an alternative faceguard 22B (FIG. 8), the front horizontal section 57B of the faceguard 22B is elongated such that its rear end 64B (i.e. at the joint 71B of the horizontal and vertical sections 57B and 58B) abuts the rear surface 43B of the receptor 30B. Thus, when a front impact occurs such as when a rider's face strikes a horse's neck or head, the force is immediately resisted without movement of the faceguard 22B. Also, the handle 59B' is shaped to create an aesthetic and highly useful arrangement where the rider is able to release the latching member 31B by pinching the handle 59B' to cause the latching member 31B to move to a release position.

Figure 9:
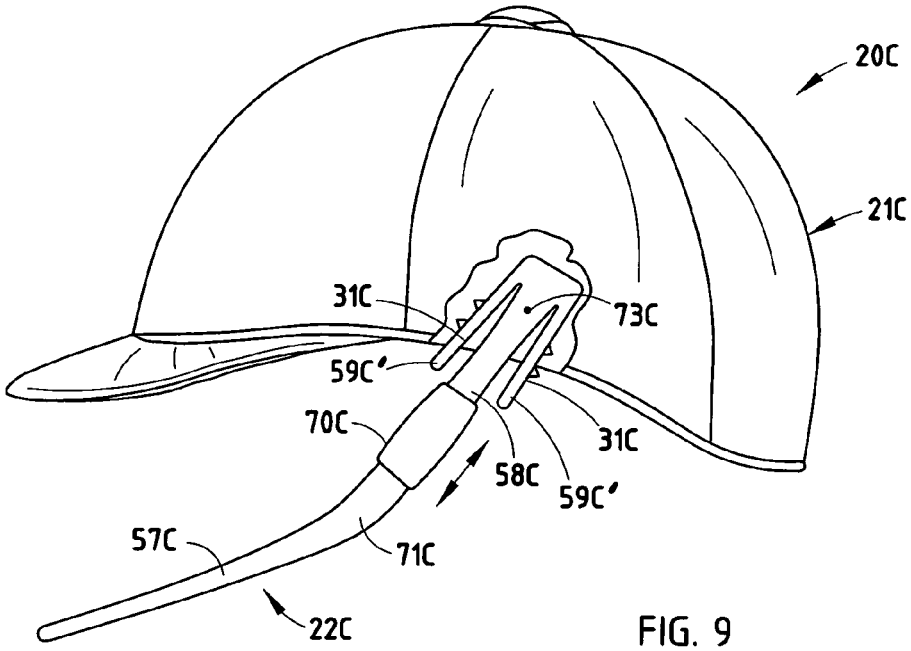

In an alternative faceguard 22C (FIG. 9) a sleeve-like locking member 70C is slidably positioned on the vertical section 58C. The locking member 70C is configured to move into the space between the latching member 31C and the vertical section 58C. A detent formed between the locking member 70C and the vertical section 58C retains the locking member 70C in its locking position until a person pulls down on the locking member 70C. This illustrated faceguard 22C includes front and rear latching members 31C and the illustrated locking member 70C includes front and rear flanges adapted to take up the spaces between the two latching members 31C and the vertical section 58C. By this arrangement, when the locking member 70C is in an up/locked position, the faceguard 22C is rigidly attached to the helmet shell 21C and is not moveable upon impact. Nonetheless, it is noted that some flexing and bending of the faceguard 22C will occur during an impact. For example, in a front impact, the horizontal and vertical sections 57C and 58C will torsionally absorb energy as they bend, particularly at their joint 71C.

Figure 10:
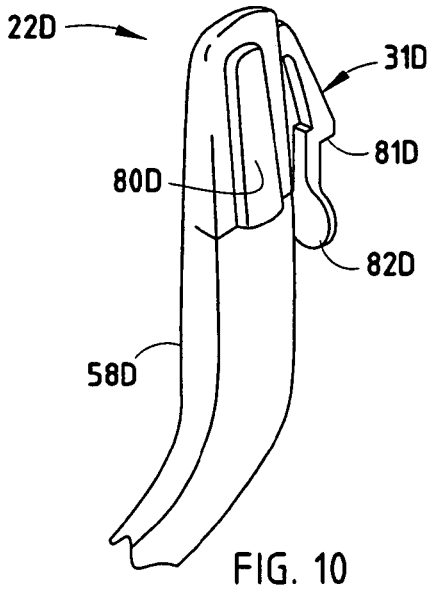
FIG. 10 is a perspective view of an alternative faceguard with a modified latching system.

FIG. 10 discloses a particular faceguard 22D where the tail end of the vertical section 58D includes a protruding guide ramp section 80D on an outboard side surface having a width narrower than the section 58D. The ramp section 80D helps with alignment and stabilization of the blade in the helmet. Also, the latching member 31D is modified to be thinner than the vertical section 58, and to include a distinctive step 81D that helps to form a positive engagement with the mating step in the receptacle in the helmet and helps to provide the distinctive click noise during positive latching engagement. The lower end of the latching member 31D includes an enlarged tab 82D forming an enlarged surface for receiving a finger when pressing the latching member 31D to release the faceguard 22D. The other side of the faceguard 22D is similarly shaped.

Figure 1:
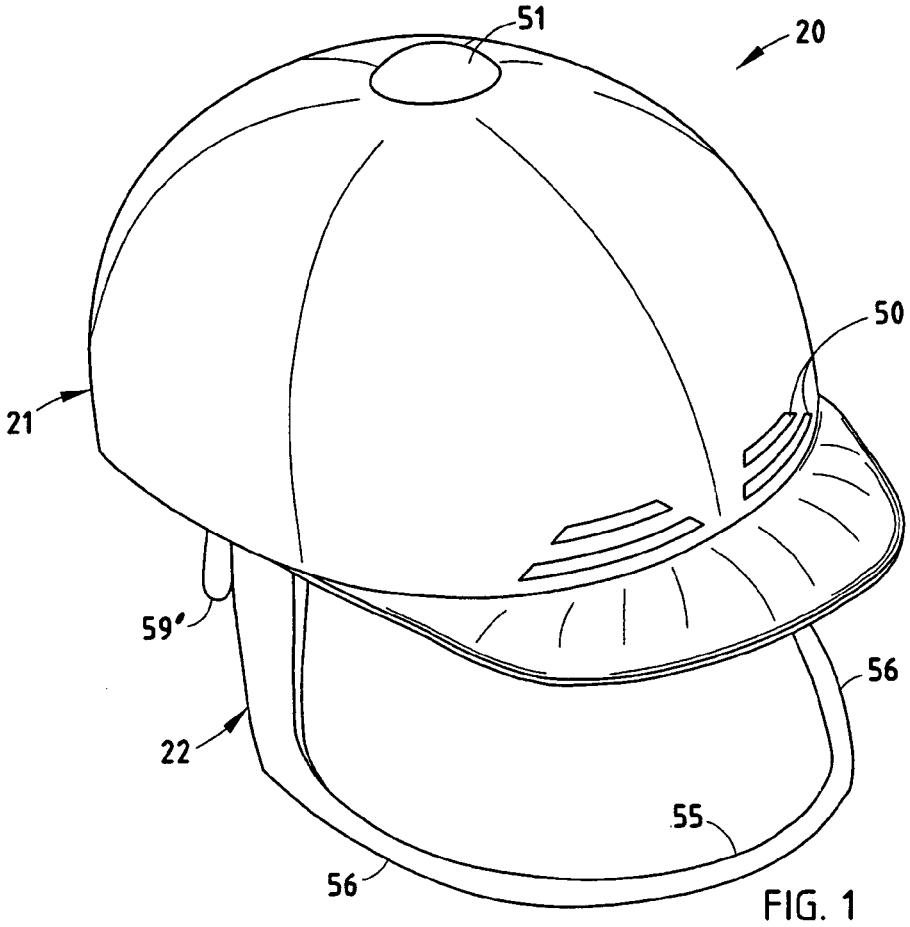
FIGS. 1–2 are perspective and side views of an equestrian helmet embodying the present invention.
Figure 2:
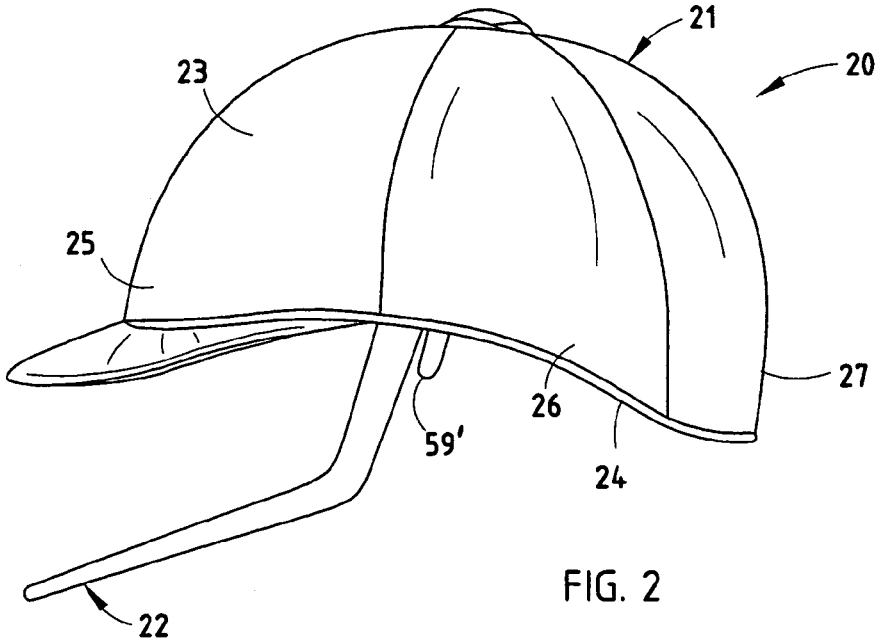
Figure 11:
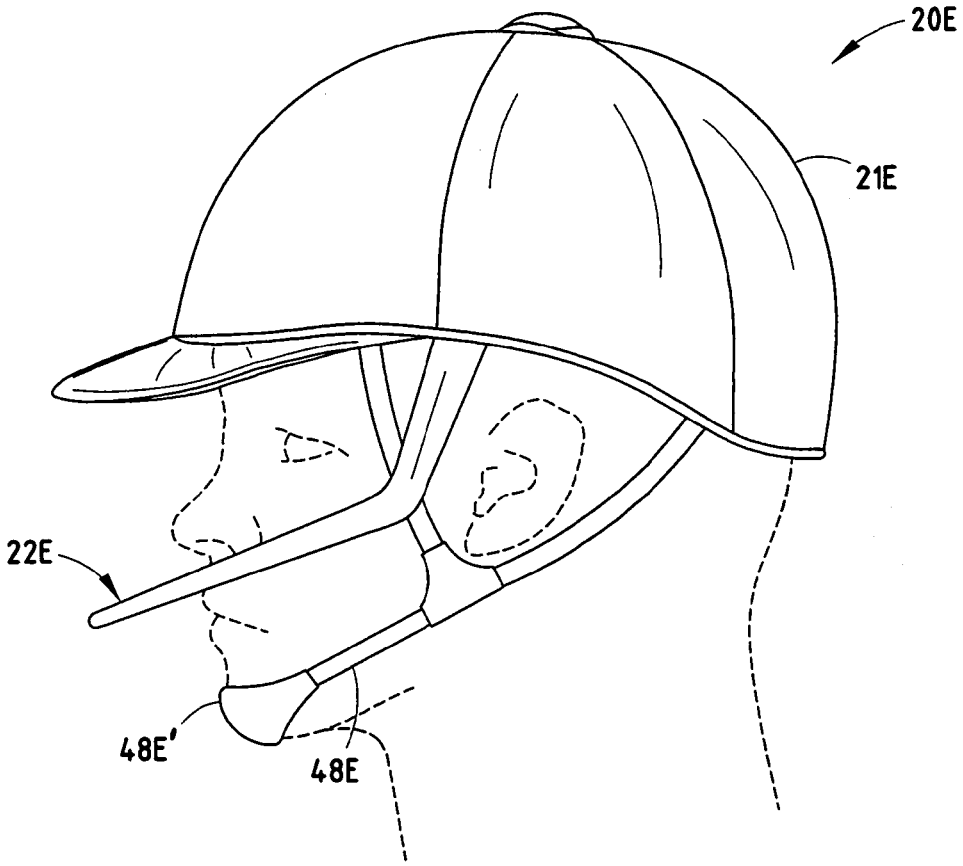
FIG. 11 is a side view of another equestrian helmet embodying the present invention.

FIG. 11 discloses a particular helmet 20E having a shell 21E and faceguard 22E similar to that shown in FIG. 1, but with a chin strap 48E with a chin-engaging section 48E'.

(Compare FIGS. 3 and 11.)

It is also contemplated that the designs illustrated in the various FIGS. 1–11 are novel, ornamental and unobvious and hence patentable based on their aesthetics.

It is to be understood that variations and modifications can be made on the aforementioned structure without departing from the concepts of the present invention and further it is to be understood that such concepts are intended to be covered by the following claims unless these claims by their language expressly state otherwise.

I claim:

1. An equestrian helmet comprising:

an impact resistant outer helmet shell formed and adapted to cover a portion of a wearer's head, the shell having an upper dome and also having a lower rim extending from a forward portion of the dome and then rearwardly above the wearer's ears to a pair of lateral side portions of the dome and then rearwardly and downwardly to a rearward portion of the dome where the rim is at its lowest point; the shell defining an outer surface and an inner surface with the outer surface at the lateral side portions being relatively smooth and characteristically not having outward protrusions thereon for safety and so that the helmet shell is adapted to receive fabric coverings without interference, but the lateral side portions having attachment structure inboard of the outer surface and defining receptors that generally are not visible from the side of the helmet; and a faceguard with arms shaped to releasably engage the receptors of the attachment structure.

2. The equestrian helmet defined in claim 1, including a protective inner helmet liner positioned within the outer helmet shell, the liner including a recess inboard of the attachment structure for receiving the attachment structure.

3. The equestrian helmet defined in claim 2, including a visor positioned on the forward portion of the dome and extending forwardly.

4. The equestrian helmet defined in claim 3, including a fabric covering on the helmet shell and that covers the outer surface, the fabric covering including a lower edge retainer for retaining the fabric covering on the helmet shell.

5. The equestrian helmet defined in claim 4, wherein the lower edge retainer includes one of an elastic cord and a draw string.

6. The equestrian helmet defined in claim 1, wherein the faceguard includes a releasable latch member on each of the arms that is movable to engage and disengage the attachment structure on the helmet shell.

7. The equestrian helmet defined in claim 6, wherein the latch member is integrally formed as part of the arms.

8. The equestrian helmet defined in claim 1, wherein the attachment structure includes a pocket integrally formed in the helmet.

9. The equestrian helmet defined in claim 8, wherein the pocket has a non-uniform cross section along its length and includes at least one detent tooth along at least one side, and wherein the faceguard includes a releasable latch member on each of the arms shaped to mateably releasably engage the pocket, the latch member including a feature to positively engage the detent tooth.

10. The equestrian helmet defined in claim 1, wherein the arms each include a latch member, and wherein the attachment structure and the latch member include mating teeth shaped to snap into engagement with an audible click when the faceguard is fully attached to the helmet shell.

11. The equestrian helmet defined in claim 1, wherein the arms each include a latch member biased into engagement with the attachment structure but movable out of engagement by pinching the latch members against a remaining portion of the arms.

12. The equestrian helmet defined in claim 1, wherein the arms each include a latch member movably attached to the arms for frictionally engaging the attachment structure, and further include a locking member movable on the arms to a locking position for preventing accidental release of the latch member.

13. The equestrian helmet defined in claim 1, wherein the receptors are integrally formed on the helmet shell on an internal portion of the lateral side portions.

14. The protective helmet defined in claim 13, including a protective inner helmet liner positioned within the outer helmet shell, the liner including a recess located inboard of and receiving the attachment structure.

15. A protective helmet comprising:

an impact resistant outer helmet shell formed to cover a portion of a wearer's head, the shell having an upper dome and also having a continuous lower rim extending from a forward portion of the dome, and then rearwardly to a pair of lateral side portions of the dome, and then rearwardly to a rearward portion of the dome; the shell defining an outer surface and an inner surface, with the outer surface at the lateral side portions characteristically not having outward protrusions thereon, but having attachment structures located only on right and left sides of the helmet shell and facing generally downwardly and inboard of the outer surface of the shell; and a faceguard with arms having rear sections that extend upwardly into releasable engagement with the attachment structure, the rear sections stably engaging the attachment structures and providing the only support for the faceguard on the helmet shell.

16. The protective helmet defined in claim 15, wherein the attachment structure is integrally formed as part of the shell.

17. A protective helmet comprising:

an impact resistant outer helmet shell formed to cover a portion of a wearer's head, the shell having an upper dome and also having a lower rim extending from a forward portion of the dome, and then rearwardly to a pair of lateral side portions of the dome, and then rearwardly to a rearward portion of the dome; the outer helmet shell including attachment structures located in the lateral side portions of the dome; and a one-piece faceguard with arms each having an end and an integrally-formed latch member supported by a living hinge, the latch member being integrally-formed with the faceguard and being shaped to releasably engage the attachment structure as the arms are fully inserted into the attachment structure.

18. A protective helmet comprising:

an impact resistant outer helmet shell formed to cover a portion of a wearer's head, the shell having an upper dome and also having a continuous lower rim extending from a forward portion of the dome, and then rearwardly to a pair of lateral side portions of the dome, and then rearwardly to a rearward portion of the dome; the shell defining an outer surface and an inner surface, with the outer surface at the lateral side portions characteristically not having outward protrusions thereon, but having attachment structures facing generally downwardly and inboard of the outer surface of the shell; and a faceguard with arms having rear sections that extend upwardly into releasable engagement with the attachment structure, wherein the arms each include a latch member movably attached to the arms for frictionally engaging the attachment structure, and further include a locking member movable on the arms for preventing accidental release of the latch member.

19. The protective helmet defined in claim 18, including a fabric covering on the helmet shell and covering the outer surface, the fabric covering including a lower edge retainer for retaining the fabric covering on the helmet shell.

20. The protective helmet defined in claim 18, wherein the faceguard includes a releasable latch member on each of the arms that is movable to engage and disengage the attachment structure on the helmet shell.

21. The protective helmet defined in claim 20, wherein the latch member is integrally formed as part of the arms.

22. The protective helmet defined in claim 18, wherein the attachment structure includes a pocket integrally formed in the helmet.

23. The protective helmet defined in claim 18, wherein the arms each include a latch member, and wherein the attachment structure and the latch member include mating teeth shaped to snap into engagement with an audible click when the faceguard is fully attached to the helmet shell.

24. The protective helmet defined in claim 18, wherein the faceguard comprises a U-shaped member.

25. A protective helmet comprising:

an impact resistant outer helmet shell formed to cover a portion of a wearer's head, the shell having an upper dome and also having a lower rim extending from a forward portion of the dome, and then rearwardly to a pair of lateral side portions of the dome, and then rearwardly to a rearward portion of the dome; the outer helmet shell including attachment structures located only in the lateral side portions of the dome; and a faceguard with arms each having a resiliently-supported latch member thereon, the latch member being shaped to releasably engage the attachment structure and in particular being constructed to engage with an audible click as the arms are fully inserted into the attachment structure, the arms stably engaging the attachment structures and providing the only support for the faceguard on the helmet shell.

26. The protective helmet defined in claim 25, wherein the faceguard comprises a U-shaped member.

27. The protective helmet defined in claim 25, wherein the faceguard comprises a U-shaped member.

28. A protective helmet comprising:

an impact resistant outer helmet shell formed to cover a portion of a wearer's head, the shell having an upper dome and also having a lower rim extending from a forward portion of the dome, and then rearwardly to a pair of lateral side portions of the dome, and then rearwardly to a rearward portion of the dome; the outer helmet shell including attachment structure located inside and integrally formed in the lateral side portions of the dome and that defines a pocket opening downwardly; and a U-shaped faceguard having a cross bar and L-shaped arms that extend upwardly from each side of the cross bar, the arms each having a horizontal section that extends generally horizontally from the cross bar and having a vertical section that extends upwardly into engagement with the attachment structure, with a rear part of the horizontal section being located near the attachment structure so that stress from a frontal impact is transmitted from the cross bar through the horizontal section to the attachment structure and the helmet shell without excessive damaging torque being transmitted to the vertical section.

29. The protective helmet defined in claim 28, wherein the cross bar comprises a single cross bar.

30. The protective helmet defined in claim 28, wherein the cross bar comprises a polymeric material.

31. A faceguard for a protective helmet, comprising:

a one-piece faceguard having a crossbar adapted to protect a chin region of a person wearing the helmet, and having legs extending rearwardly from opposing ends of the crossbar, the legs each having a rearwardly-extending section and having an upwardly-extending section that is adapted to extend into contact with the helmet, the upwardly-extending section having an integrally-formed latch element supported by an integrally-formed living hinge thereon and that is adapted to interlockingly engage a mating pocket in the helmet.

32. The protective helmet defined in claim 31, wherein the faceguard comprises a U-shaped member.

33. A protective helmet comprising:

an impact resistant outer helmet shell formed to cover a portion of a wearer's head, the shell having an upper dome and also having a lower rim extending from a forward portion of the dome, and then rearwardly to a pair of lateral side portions of the dome, and then rearwardly to a rearward portion of the dome; the outer helmet shell including attachment structures located in the lateral side portions of the dome;

a faceguard with arms each having an end shaped to fit into the attachment structures; and latch members each supported by a hinge for releasably retaining the arms to the attachment structures, the latch members each including a finger-releasable handle extending downwardly and that is accessible from below the lower rim to release the latch members to remove the faceguard from the helmet shell.

34. The protective helmet defined in claim 33, wherein the faceguard comprises a U-shaped member.

35. A protective helmet comprising:

an impact resistant outer helmet shell formed to cover a portion of a wearer's head, the shell having an upper dome and also having a lower rim extending from a forward portion of the dome, and then rearwardly to a pair of lateral side portions of the dome, and then rearwardly to a rearward portion of the dome; the outer helmet shell including attachment structures located in the lateral side portions of the dome, the outer helmet shell including downwardly facing attachment structures; and a faceguard with arms each having an end and a latch member supported by a hinge, the latch member being shaped to releasably engage the attachment structure as the arms are fully inserted into the attachment structure, with the arms stably engaging the attachment structures and providing the only support for the faceguard on the helmet shell.

* * * * *